US009848462B2

(12) United States Patent
Lee et al.

(10) Patent No.: US 9,848,462 B2
(45) Date of Patent: Dec. 19, 2017

(54) TEMPERATURE SENSOR AND INDUCTION HEATING COOKER HAVING THE SAME

(75) Inventors: Sung Ho Lee, Suwon-si (KR); Jong Chull Shon, Suwon-si (KR); Ha Na Kim, Incheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 971 days.

(21) Appl. No.: 13/067,990

(22) Filed: Jul. 13, 2011

(65) Prior Publication Data

US 2012/0024840 A1 Feb. 2, 2012

(30) Foreign Application Priority Data

Jul. 28, 2010 (KR) ..... 10-2010-0072854

(51) Int. Cl.
*H05B 6/12* (2006.01)
*H05B 6/06* (2006.01)

(52) U.S. Cl.
CPC ..... *H05B 6/062* (2013.01); *H05B 2213/04* (2013.01); *H05B 2213/07* (2013.01)

(58) Field of Classification Search
CPC ..... H05B 6/062
USPC ..... 219/622, 623, 624, 627, 677, 667, 662, 219/632, 676
See application file for complete search history.

(56) References Cited

U.S. PATENT DOCUMENTS 5,428,207 A * 6/1995 Essig et al. ..... 219/622
5,536,918 A * 7/1996 Ohkase et al. ..... 219/390
6,498,325 B1 * 12/2002 Akel ..... H05B 6/065 219/624
2003/0178416 A1 9/2003 Fujii et al.
2007/0125768 A1 6/2007 Kim et al.
2007/0273392 A1 * 11/2007 Bodecker ..... A61B 5/031 324/654
2007/0278215 A1 * 12/2007 Schilling et al. ..... 219/622
2009/0321424 A1 * 12/2009 Bunuel Magdalena ..... H05B 6/062 219/620
2010/0065550 A1 * 3/2010 Tominaga et al. ..... 219/622
2010/0237064 A1 * 9/2010 Liu et al. ..... 219/622

FOREIGN PATENT DOCUMENTS

CN 1447627 A 10/2003
CN 1526260 A 9/2004
CN 101622905 1/2010
EP 0412875 A1 2/1991
EP 2337426 A1 6/2011
JP 10-69975 3/1998

OTHER PUBLICATIONS

European Search Report for corresponding European Patent Application No. 11174076.7 dated Nov. 14, 2011 (in English).

(Continued)

*Primary Examiner* — Phuong Nguyen
(74) *Attorney, Agent, or Firm* — Staas & Halsey LLP

(57) ABSTRACT

An induction heating cooker including a temperature sensor disposed between a plurality of working coils which are uniformly disposed below a cooking table and a heat transfer member to transfer heat from the working coils adjacent to the temperature sensor to the temperature sensor, thereby improving productivity and space utilization.

21 Claims, 9 Drawing Sheets

(56) References Cited

OTHER PUBLICATIONS

Korean Office Action dated Jun. 27, 2014 in corresponding Korean Patent Application 10-2010-0072854.
Korean Notice of Allowance dated Jan. 20, 2015 in corresponding Korean Patent Application 10-2010-0072854.
Chinese Office Action dated Dec. 2, 2014 in corresponding Chinese Patent Application 201110212593.4.
Chinese Office Action dated Jul. 23, 2015 in Chinese Patent Application No. 201110212593.4.

* cited by examiner

TEMPERATURE SENSOR AND INDUCTION HEATING COOKER HAVING THE SAME

CROSS-REFERENCE TO RELATED APPLICATIONS

This application claims the priority benefit of Korean Patent Application No. 2010-0072854, filed on Jul. 28, 2010 in the Korean Intellectual Property Office, the disclosure of which is incorporated herein by reference.

BACKGROUND

1. Field

Embodiments relate to an induction heating cooker having a temperature sensor to sense temperature of a working coil or an object to be heated.

2. Description of the Related Art

Generally, an induction heating cooker is an apparatus which supplies high-frequency current to a heating coil to generate a strong high-frequency magnetic field in the heating coil and to generate an eddy current in an object to be heated, magnetically coupled to the heating coil, using the high-frequency magnetic field such that the object is heated using Joule's heat generated by the eddy current, thereby cooking the object.

In the induction heating cooker, a position where an object to be heated is to be placed, is displayed on a top plate on which the object is placed, and a container is placed on the position such that the container is heated by a working coil below the top plate.

In recent years, the induction heating cooker has been provided with a function to sense the position where a container is placed although the container is not placed at a predetermined position.

In this case, a plurality of working coils are disposed throughout a cooking plate. A temperature sensor is provided with respect to the working coils so as to sense heat generated from the working coils.

SUMMARY

It is an aspect to provide an induction heating cooker including a temperature sensor to measure temperature of working coils.

Additional aspects will be set forth in part in the description which follows and, in part, will be apparent from the description, or may be learned by practice of the invention.

In accordance with one aspect, an induction heating cooker includes a cooking table on which an object to be heated is placed, a working coil and a temperature sensor disposed below the cooking table, and a heat transfer member to transfer heat from the working coil to the temperature sensor.

The heat transfer member may partially contact the working coil so as to transfer heat to the working coil.

The heat transfer member may be made of a nonmagnetic material exhibiting high thermal conductivity.

The heat transfer member may be made of copper, aluminum, or stainless steel.

The heat transfer member may include a heat pipe including a hermetically sealed pipe filled with a predetermined amount of an operating fluid phase of which is variable.

The temperature sensor may include a contact temperature sensor or a non-contact temperature sensor.

The working coil may include a plurality of working coils disposed in the form of a grid or a honeycomb.

The working coil may include a plurality of working coils disposed below the cooking table, the temperature sensor may be disposed between working coils, and the heat transfer member may extend from the temperature sensor to the working coils.

The heat transfer member may be disposed to transfer heat to each of the working coils adjacent to the temperature sensor.

The heat transfer member may be disposed to transfer heat to two or more of the working coils disposed around the temperature sensor.

The temperature sensor may have a sensing unit to cover a sensor element, and the heat transfer member may extend from one side of the sensing unit such that the heat transfer member is integrated with the sensing unit.

The sensing unit may include a plurality of sensing zones divided by heat insulation walls and sensor elements in the respective sensing zones, and the heat transfer member may extend from one side of each of the sensing zones.

In accordance with another aspect, a temperature sensor of an induction heating cooker including a cooking table on which an object to be heated is placed and a plurality of working coils disposed below the cooking table, disposed between the working coils to measure temperature of the object, includes a sensing unit to cover a sensor element and one or more heat transfer members extending from one side of the sensing unit.

The one or more heat transfer members may be made of a nonmagnetic material exhibiting high thermal conductivity.

The one or more heat transfer members may be disposed around the sensing unit radially.

Each of the one or more heat transfer members may include a heat pipe.

The temperature sensor may include a platinum resistance temperature sensor, a thermocouple, a thermistor, or an IC temperature sensor.

The sensing unit may include a plurality of sensing zones, divided by heat insulation walls, each including a sensor element provided therein, and each of the one or more heat transfer members may extend from one side of each of the sensing zones.

In accordance with another aspect, an induction heating cooker includes a main body, a cooking table disposed at a top of the main body such that an object to be heated is placed on the cooking table, a plurality of working coils disposed below the cooking table to heat the object, an inverter unit to supply high-frequency current to the working coils, a drive unit to turn a switching element of the inverter unit on/off, a controller to control the drive unit and other components of the induction heating cooker, a temperature sensor disposed between the working coils to measure temperature of the object, one or more heat transfer member disposed around the temperature sensor radially to transfer heat generated from the object heated by the working coils disposed adjacent to the temperature sensor to the temperature sensor.

The controller may detect an output signal based on the temperature measured by the temperature sensor and stop the operation of the inverter unit when the temperature of the object is abnormally increased.

The induction heating cooker may further include a signal cutoff unit to turn a signal transmitted from the controller to the drive unit on/off based on the output signal of the temperature sensor, and the signal cutoff unit may cut off the signal transmitted from the controller to the drive unit when the temperature of the object is equal to or greater than a predetermined temperature.

In accordance with a further aspect, an induction heating cooker includes a cooking table comprising one or more predetermined zones, at least one working coil and a temperature sensor disposed below each of the one or more predetermined zones, and a heat transfer member to transfer heat from the at least one working coil to the temperature sensor.

The at least one working coil may include a plurality of working coils below each of the one or more predetermined zones such that the working coils are adjacent to each other, and the heat transfer member may include a plurality of heat transfer members the number of which corresponds to the number of the working coils below each of the one or more predetermined zones, the heat transfer members extending from the temperature sensor to the respective working coils.

The one or more predetermined zones may include a plurality of predetermined zones disposed below the cooking table, the at least one working coil may include a plurality of working coils disposed below the cooking table, the temperature sensor may include a plurality of temperature sensors disposed below the cooking table, and the heat transfer member may include a plurality of heat transfer members disposed below the cooking table.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
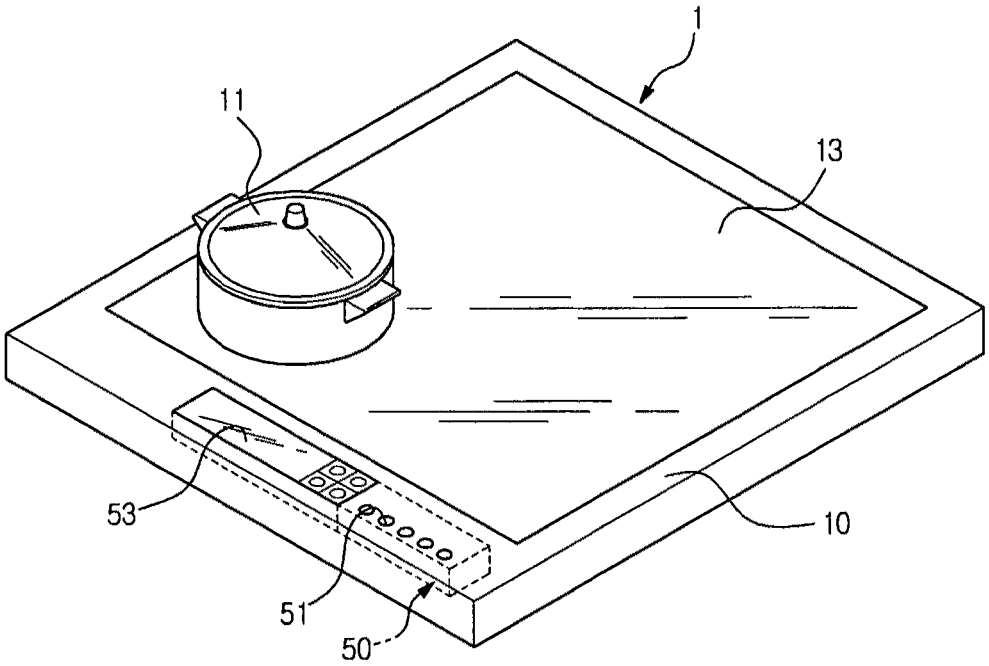
FIG. 1 is a perspective view schematically illustrating the structure of an induction heating cooker according to an embodiment.

Reference will now be made in detail to the embodiments, examples of which are illustrated in the accompanying drawings, wherein like reference numerals refer to like elements throughout.

Figure 2:
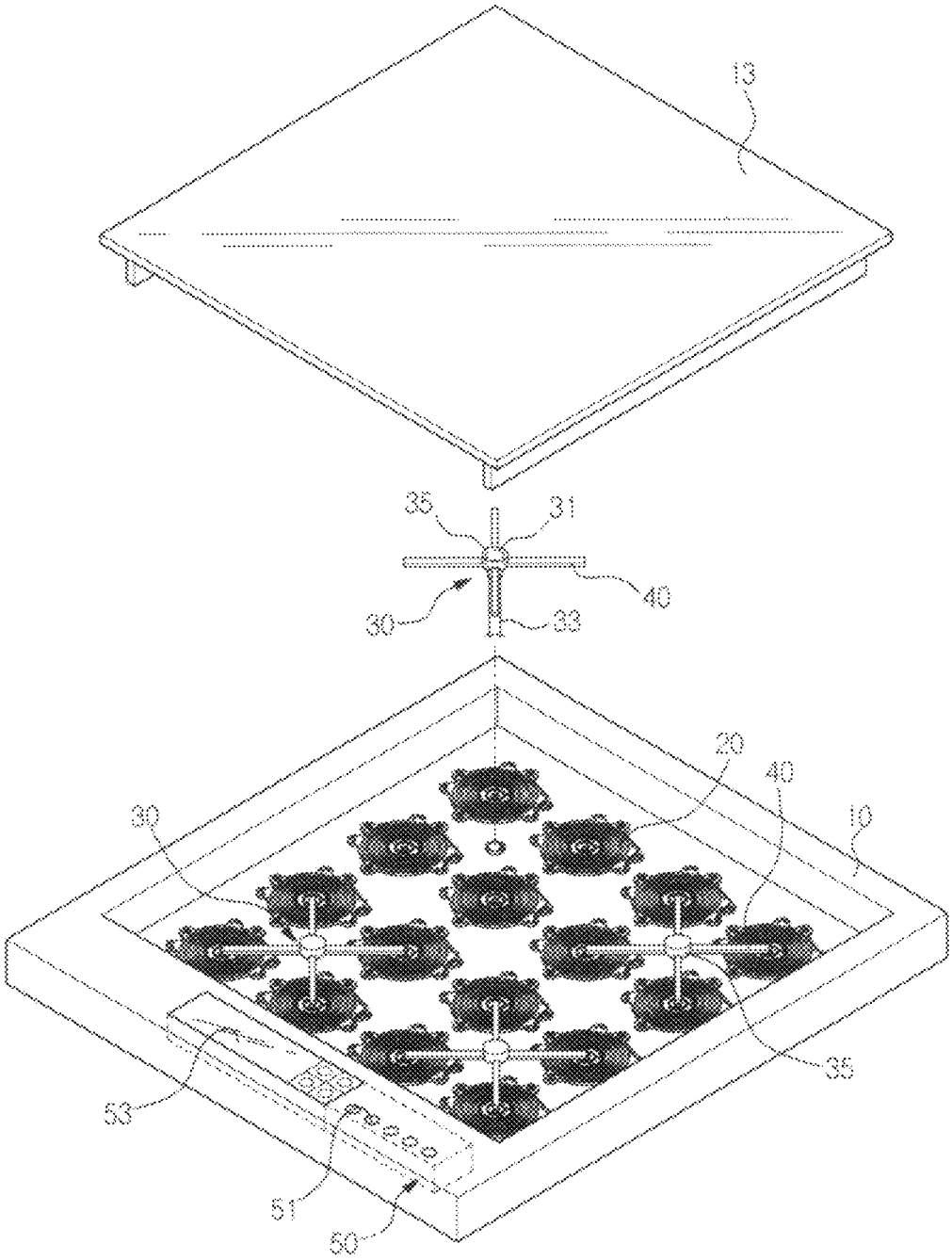
FIG. 2 is an exploded perspective view of FIG. 1.

FIG. 1 is a perspective view schematically illustrating the structure of an induction heating cooker 1 according to an embodiment, and FIG. 2 is an exploded perspective view of FIG. 1.

Referring to FIGS. 1 and 2, the induction heating cooker 1 includes a main body 10 forming the external appearance of the induction heating cooker 1 and a cooking table 13 located at the top of the main body 10 such that an object 11 to be heated, for example, a cooking container, is placed on the cooking table 13.

The main body 10 is formed in the shape of a box open at the top thereof. The cooking table 13 covers the open top of the main body 10.

The cooking table 13 is formed in the shape of a flat board on which the object 11 is placed. The cooking table 13 may be made of tempered glass, for example, ceramic glass, such that the cooking table is not easily broken or scratched.

A plurality of working coils 20 to induction heat the object 11 placed on the cooking table 13 are mounted below the cooking table 13.

The working coils 20 are uniformly disposed in the main body 10 such that the object 11 is heated over entire area of the cooking table 13.

The working coils 20 may be disposed in the form of a grid including parallel lines intersecting at right angles at regular intervals. The number of the working coils 20 may be changed depending upon the size of the main body 10. In this embodiment, the number of the working coils 20 is 16 to 20, for example.

Meanwhile, arrangement of the working coils 20 is not particularly restricted as long as the intervals of the working coils 20 are reduced such that cooking is performed at any position of the cooking table 13. For example, the working coils 20 may be disposed in the form of a honeycomb.

In this structure, the cooking table 13 may not have specific cooking zones corresponding to the working coils 20.

A controller 50 to control the operation of the induction heating cooker 1 is disposed at the main body 10 in front of the cooking table 13. The controller 50 includes a manipulation switch 51 to allow a user to input a cooking command and a display 53 to display a state of the induction heating cooker 1.

A plurality of temperature sensors 30 to sense temperature of the working coils 20 or the object 11, are disposed between the working coils 20.

When the temperature of the object 11 cooked on the cooking table 13 is abnormally increased, the temperature sensors 30 sense the abnormal temperature of the working coils 20 or the object 11 and transmits the sensed temperature to the controller 50 such that the controller 50 stops the operation of the induction heating cooker 1.

Each of the temperature sensors 30 may be embodied as a thermistor element where the internal resistance value of which changes based on the change of ambient temperature. The thermistor may be a negative temperature coefficient (NTC) thermistor, a positive temperature coefficient (PTC) thermistor, or a critical temperature resistor (CTR) thermistor.

As shown in FIG. 2, each of the temperature sensors 30 includes a thermistor 31 including electrodes provided at opposite sides thereof, a plurality of lead wires 33, one end of each of the lead wires 33 being connected to a corresponding one of the electrodes, and a sensing unit 35 surrounding the thermistor 31, a portion of each of the lead wires 33 protecting the thermistor 31.

In this embodiment, each of the temperature sensors 30 is embodied as a contact temperature sensor 30 using a thermistor element, to which, however, embodiments are not limited. For example, each of the temperature sensors 30 may be embodied as a thermocouple, a bimetal, an IC temperature sensor, or an infrared sensor, which is a non-contact sensor.

Generally, the number of the temperature sensors 30 is equal to the number of the working coils 20. In this embodiment, however, the number of the temperature sensors 30 is less than the number of the working coils 20.

To this end, each of the temperature sensors 30 includes a plurality of heat transfer members 40 to transfer heat to the corresponding working coils 20 adjacent to each of the temperature sensors 30. One end of each of the heat transfer members 40 is connected to a corresponding one of the temperature sensors 30.

That is, as shown in FIG. 2, each of the temperature sensors 30 includes a plurality of heat transfer members 40 radially extending from the sensing unit 35.

The heat transfer members 40 may be integrated with the sensing unit 35. Alternatively, the heat transfer members 40 may be manufactured separately and then coupled to the sensing unit 35.

Each of the heat transfer members 40 may be embodied as a rod made of a nonmagnetic material, such as copper, aluminum, or stainless steel, exhibiting high thermal conductivity such that heat generated from the object 11 heated by a corresponding one of the working coils 20 is transferred to a corresponding one of the temperature sensors 30.

When the heat transfer members 40 are made of the nonmagnetic material, a measurement error, resulting from heating of the heat transfer members 40 due to electromagnetic induction caused by a magnetic field generated from the working coils 20, may be reduced.

Alternatively, each of the heat transfer members 40 may be embodied as a heat pipe (not shown) to rapidly transfer heat generated from the object 11 heated by a corresponding one of the working coils 20 to a corresponding one of the temperature sensors 30.

The heat pipe may be a hermetically sealed pipe, made of copper or aluminum, filled with a predetermined amount of an operating fluid in a vacuum state, which may be varied. The operating fluid may be methanol, ethanol, acetone, ammonia, or freon exhibiting continuous phase change between gas and liquid, low boiling point, and excellent evaporation latent heat.

With the above structure, heat is rapidly transferred between opposite ends of the heat pipe, thereby further improving reliability in temperature measurement of the object 11.

Meanwhile, the heat transfer members 40 connected between a corresponding one of the temperature sensors 30 and the working coils 20 may be disposed in various forms.

FIGS. 3A to 3E are views illustrating various arrangement structures of heat transfer members according to an embodiment.

Referring to FIGS. 3A to 3E, the temperature sensors 30 are disposed between the working coils 20 which are uniformly disposed in the form of a grid or a honeycomb, and each of the heat transfer members 40 extends from a corresponding one of the temperature sensors 30 is on top of each of the working coils 20 adjacent to the corresponding one of the temperature sensors 30 in various forms so as to measure temperature of the object 11 heated by the working coils 20.

Figure 3A:
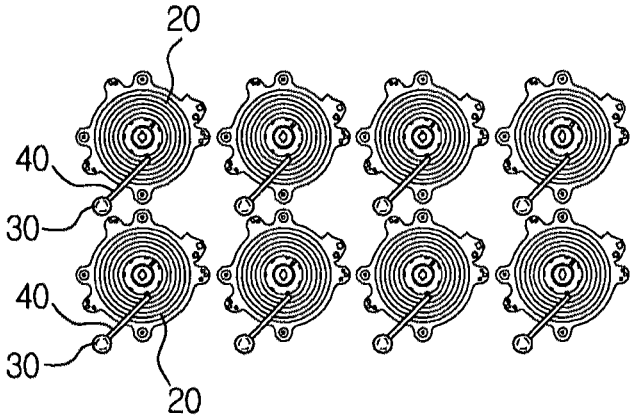
FIGS. 3A to 3E are views illustrating various arrangement structures of heat transfer members according to an embodiment.

FIG. 3A shows an arrangement in which each heat transfer member 40 is disposed to measure temperature of a working coil 20 adjacent to a temperature sensor 30. A temperature measurement range of the temperature sensor 30 is increased by the heat transfer member 40, thereby improving reliability in temperature measurement of the object 11 placed on a certain zone of the cooking table 13.

Figure 3B:
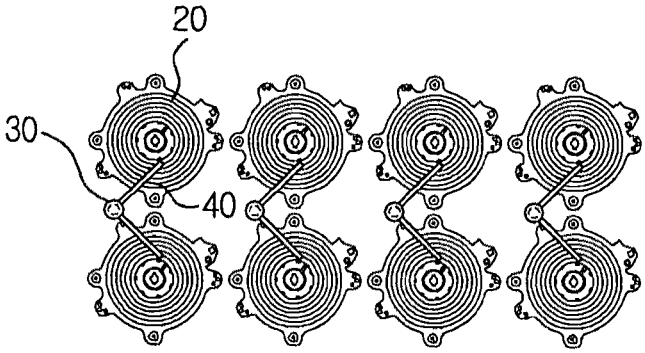
Figure 3B:
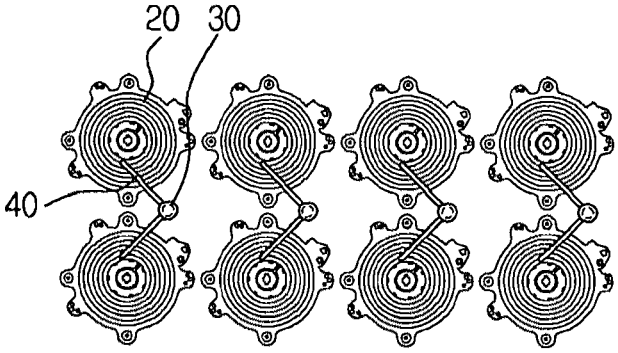

FIG. 3B shows an arrangement structure in which two heat transfer members 40 are disposed to measure temperature of two adjacent working coils 20 using a temperature sensor 30. Two heat transfer members 40 may be directed to two working coils 20 disposed about a temperature sensor 30 in upward, downward, left and right directions.

Figure 3C:
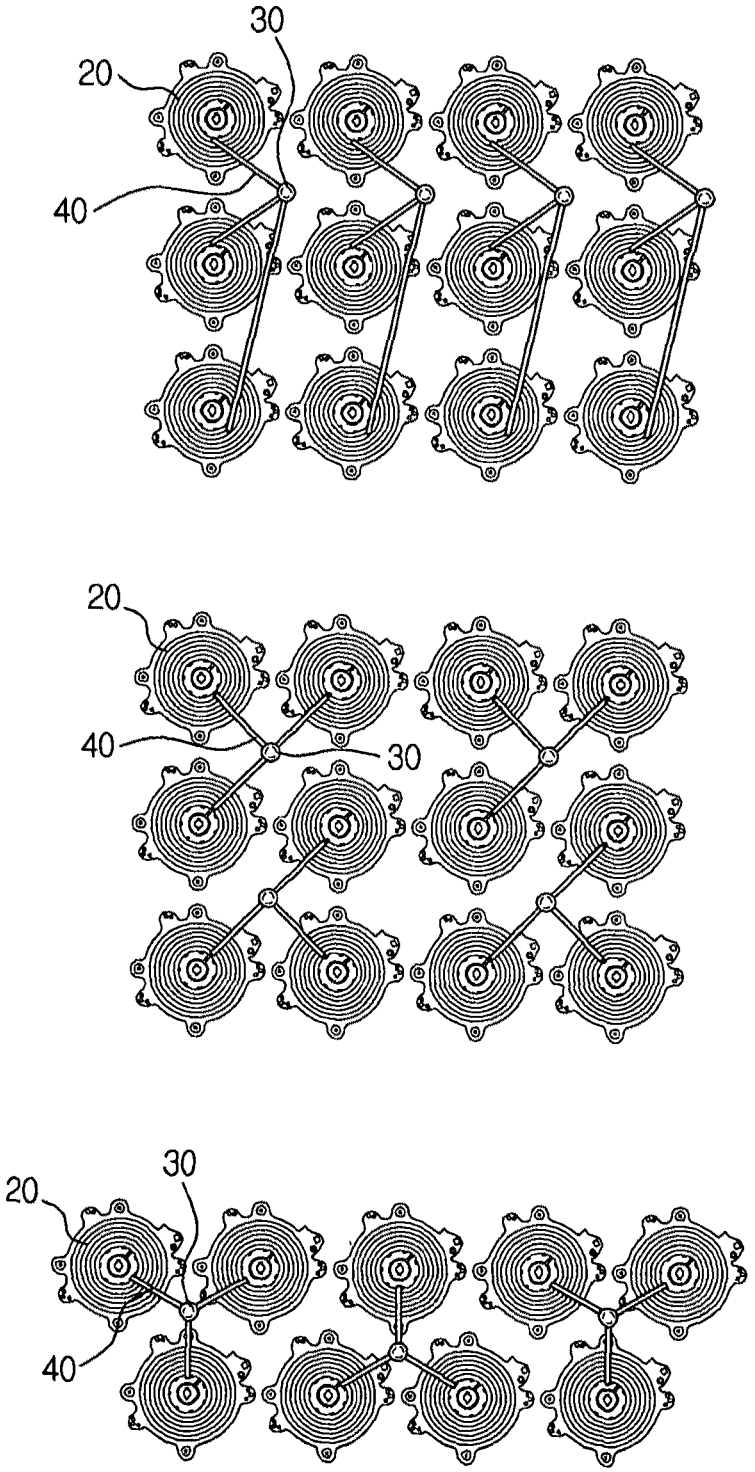
Figure 3D:
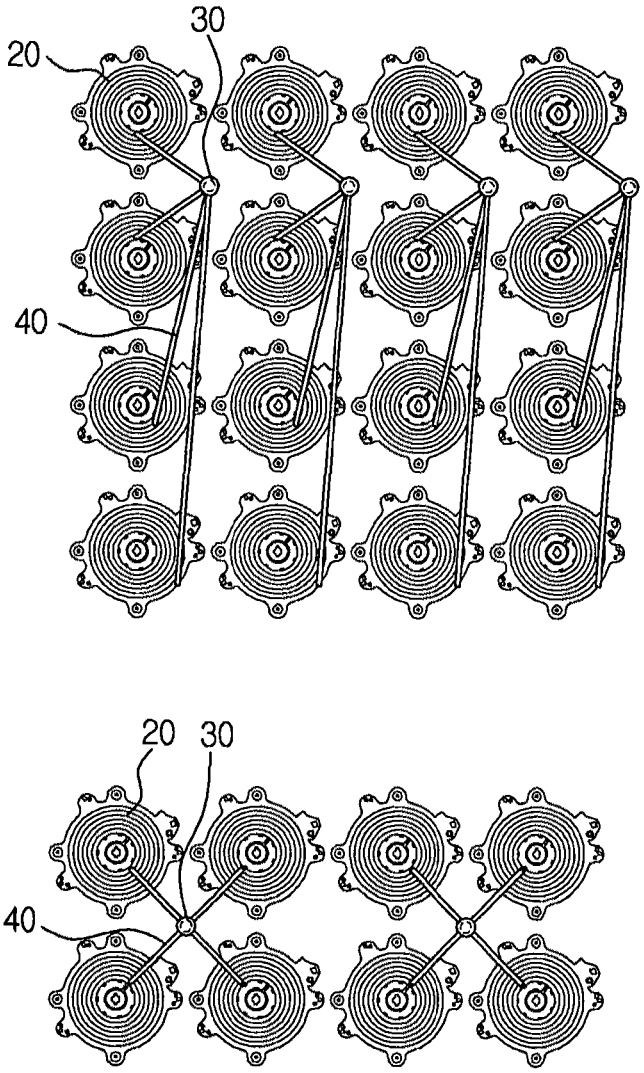

FIGS. 3C and 3D show an arrangement in which three heat transfer members 40 are disposed to measure temperature of three or four adjacent working coils 20 using a temperature sensor 30. Three or four heat transfer members 40 may be disposed at arbitrary angles such that the each of heat transfer members 40 does not share the same working coil 20. Alternatively, at least one of the three or four heat transfer members 40 may be disposed above at least two working coils 20 so as to transfer heat from the at least two working coils to the temperature sensor 30.

That is, each of the heat transfer members 40 may be disposed to transfer heat from a working coil to a temperature sensor 30, or heat from two or more working coils 20 to a temperature sensor 30.

Also, the number of the temperature sensors 30 and the arrangement of the heat transfer members 40 may be changed based on the number of the working coils 20 disposed below the cooking table 13.

For example, the heat transfer members 40 shown in FIGS. 3A to 3D may be disposed in various forms depending upon the number and size of the working coils 20 randomly disposed below the cooking table 13.

Figure 3E:
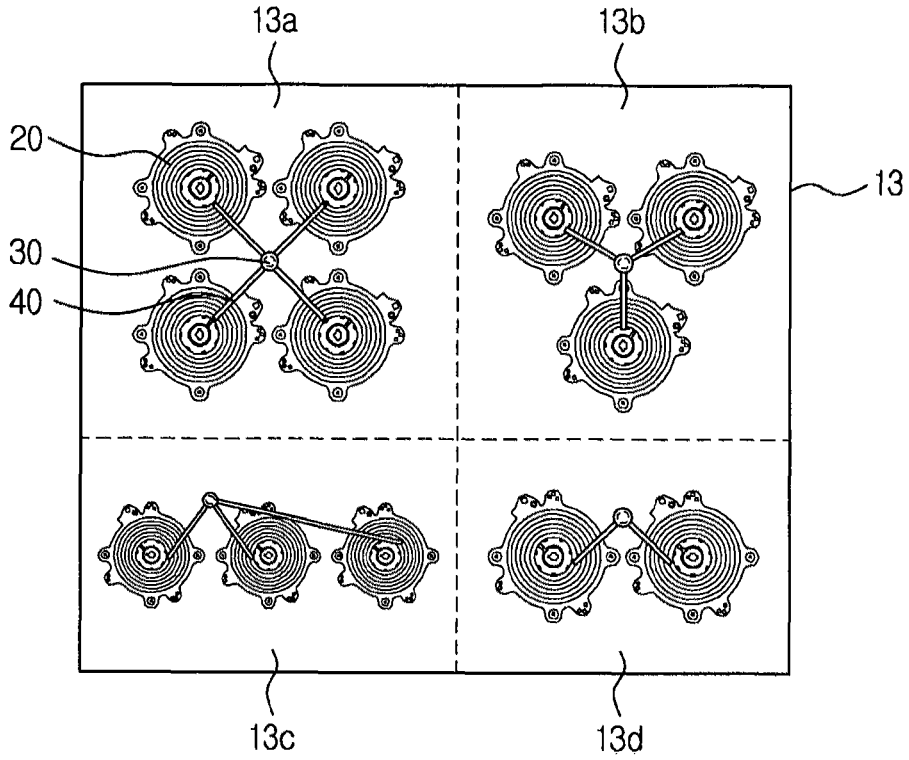

That is, as shown in FIG. 3E, the plurality of working coils 20 may be randomly disposed below the cooking table 13 depending upon the size and arrangement of the working coils 20 densely disposed adjacent to each other.

In this structure, the temperature sensors 30 are disposed below predetermined zones 13*a*, 13*b*, 13*c*, and 13*d* which are divided based on the number of the working coils 20. The heat transfer members 40 connected to the temperature sensors 30 disposed in the respective zones 13*a*, 13*b*, 13*c*, and 13*d* may be disposed in the arrangement structures of FIGS. 3A to 3D depending upon the number of the working coils 20 disposed in the respective zones 13*a*, 13*b*, 13*c*, and 13*d*.

The zones 13*a*, 13*b*, 13*c*, and 13*d* are zones arbitrarily divided depending upon the number, for example, 2 to 4 of the working coils 20.

Meanwhile, the arrangement structures of the heat transfer members 40 are not limited to the above examples. The heat transfer members 40 may be disposed in different forms depending upon the arrangement structures of the working coils 20 and the temperature sensors 30.

Also, when each of the temperature sensors 30 is embodied as a non-contact sensor, e.g., an infrared sensor, each of the temperature sensors 30 may be provided at the top thereof with a sensing unit 35 to which at least one end of each of the heat transfer members 40 is radially disposed such that the sensing unit 35 measures heat transferred through the heat transfer members 40. In this case, the infrared sensor measures the amount of infrared light emitted from the sensing unit 35 and temperature of the sensing unit 35 to detect abnormal increase in temperature of the working coils 20.

Figure 4:
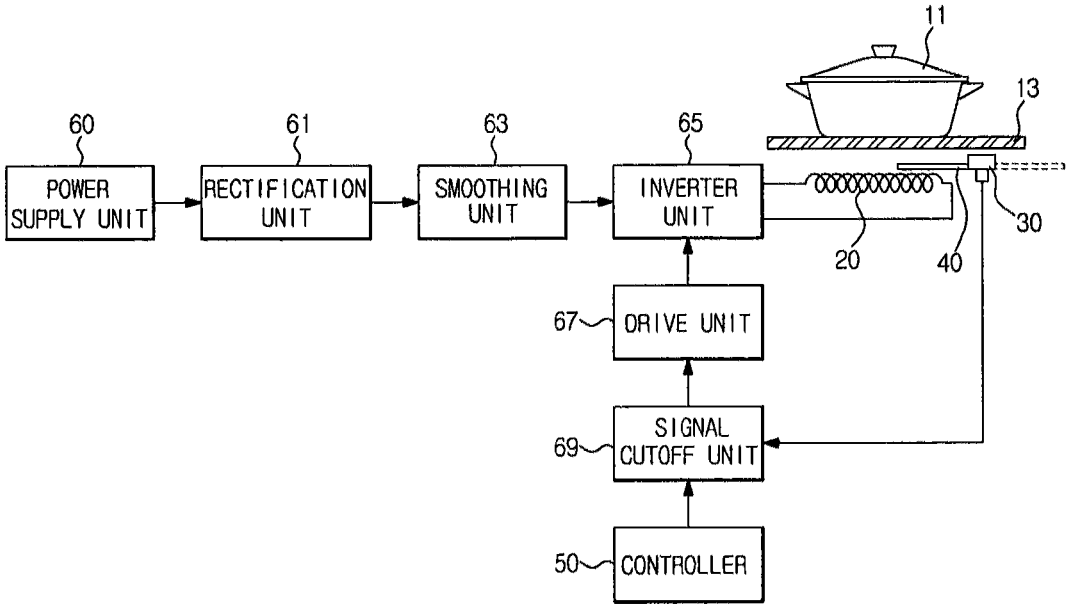
FIG. 4 is a control block diagram of the induction heating cooker.

Hereinafter, the operation of the induction heating cooker having the temperature sensors according to the embodiment will be described. FIG. 4 is a control block diagram of the induction heating cooker.

Referring to FIG. 4, the induction heating cooker includes a power supply unit 60, a rectification unit 61, a smoothing unit 63, an inverter unit 65, a drive unit 67, working coils 20, temperature sensors 30, a signal cutoff unit 69, and a controller 50.

The rectification unit 61 may be embodied as a bridge diode to rectify alternating current power input through the power supply unit 60 and to output the rectified pulsating voltage.

The smoothing unit 63 smoothes the pulsating voltage supplied from the rectification unit 61 and outputs uniform direct current voltage obtained through smoothing, i.e., smoothed voltage.

Upon application of voltage rectified and smoothed by the rectification unit 61 and the smoothing unit 63, the inverter unit 65 is switching-driven to supply high-frequency current to the working coils 20.

The drive unit 67 turns a switching element of the inverter unit 65 on or off according to a control signal of the controller 50.

The temperature sensors 30 detect temperature of the object 11 heated by electromotive force induced to the object 11 magnetically coupled to the working coils 20.

The signal cutoff unit 69 turns a signal of the controller 50 transmitted to the drive unit 67 on or off according to an output signal of the temperature sensors 30. The signal cutoff unit 69 may be embodied as a fuse disposed on a line to which power is applied. Alternatively, the signal cutoff unit 69 may be embodied as a circuit including a transistor allowing a control signal output from the controller to flow to the ground according to the output signal of the temperature sensors 30 such that the control signal is not transmitted to the drive unit 67.

The controller 50 controls the overall operation of the induction heating cooker 1 and outputs a control signal to adjust frequency of high-frequency power applied to the working coils 20.

In the induction heating cooker 1, alternating current power is rectified into direct current power, and high-frequency current is supplied to the working coils 20 through switching of the inverter unit 65.

The switching of the inverter unit 65 is adjusted by the drive unit 67. The drive unit 67 is operated according to a control signal of the controller 50.

A magnetic field is generated from the working coils 20 by alternating current supplied to the working coils 20, and an eddy current is induced to the object 11 placed on the cooking table 13 due to electromagnetic induction caused by the magnetic field, with the result that the object 11 is heated.

When the object 11 is abnormally heated, the working coils 20 may catch fire or internal components of the induction heating cooker may be damaged. To prevent the occurrence of such ignition or damage, an output signal of the temperature sensors 30 according to temperature measured by the temperature sensors 30 to measure temperature of the object 11, is transmitted to the signal cutoff unit 69. When the measured temperature is equal to or greater than a predetermined temperature, the signal cutoff unit 69 cuts off a control signal transmitted from the controller 50 to the drive unit 67, with the result that high-frequency current supplied to the working coils 20 is cut off by the signal cutoff unit 69 without control of the controller 50.

The number of the temperature sensors 30 corresponds to the number of the working coils 20. In this embodiment, however, each of the temperature sensors 30 includes heat transfer members 40 to transfer heat generated from adjacent working coils 20, with the result that temperature of the working coils adjacent to each of the temperature sensors 30 is detected through each of the temperature sensors 30. Consequently, the number of the temperature sensors 30 may be reduced, and, in addition, a space in which the temperature sensors 30 are disposed is reduced, thereby further improving space utilization.

In this embodiment, the control signal transmitted to the drive unit is cut off by the signal cutoff unit. Alternatively, the signal cutoff unit may be omitted, and the controller may directly control the drive unit to prevent overheating of the working coils.

In this embodiment, the temperature sensors measure temperature of the working coils 20 when temperature of the induction heating cooker 1 is abnormally increased. Alternatively, the temperature sensors may independently detect temperature of the working coils 20.

Figure 5:
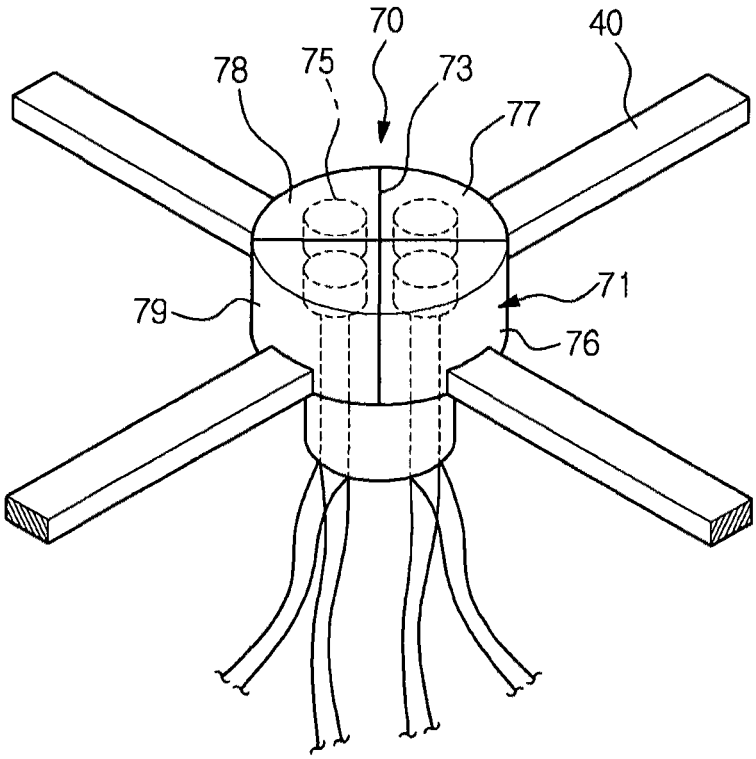
FIG. 5 is a view illustrating a temperature sensor according to another embodiment.

To this end, as shown in FIG. 5, a sensing unit 71 of a temperature sensor 70 may include a plurality of sensing zones 76, 77, 78, and 79, divided by a plurality of heat insulation walls 73, each including a plurality of sensing elements 75, and a plurality of heat transfer members 40 from the respective sensing zones 76, 77, 78, and 79 on top of a plurality of working coils 20 disposed adjacent to the temperature sensors 70, thereby independently detecting temperature of the respective working coils 20.

Each of the sensor elements 75 may be embodied as a platinum resistance temperature sensor, a thermocouple, or a thermistor designed for temperature measurement.

With the above structure, the temperature sensor 70 may detect the position of the object 11 placed on the cooking table 13, or adjust heating power or cooking time based on the temperature of the object 11.

Even in this case, temperatures of working coils 20 are independently sensed by a single temperature sensor, thereby improving productivity and space utilization.

As is apparent from the above description, the induction heating cooker according to the embodiment has improved productivity and space utilization.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An induction heating cooker comprising:

a cooking table on which an object to be heated is placed;

at least two working coils and at least one temperature sensor disposed below the cooking table; and at least two heat transfer members to transfer heat from the at least two working coils to the at least one temperature sensor, wherein the at least one temperature sensor is disposed radially outside the at least two working coils, and connected to the at least two working coils by the at least two heat transfer members, and wherein first ends of the at least two heat transfer members are disposed on a heating region of the at least two working coils between the at least two working coils and the cooking table and spaced apart from the at least two working coils, and second ends of the at least two heat transfer members are connected to the at least one temperature sensor.

2. The induction heating cooker according to claim 1, wherein the at least two heat transfer members partially contact the at least two working coils so as to transfer heat to the at least two working coils.

3. The induction heating cooker according to claim 1, wherein the at least two heat transfer members are made of a nonmagnetic material exhibiting high thermal conductivity.

4. The induction heating cooker according to claim 3, wherein the at least two heat transfer members are made of any one of copper, aluminum, or stainless steel.

5. The induction heating cooker according to claim 1, wherein the at least two heat transfer members comprise a heat pipe including a hermetically sealed pipe filled with a predetermined amount of an operating fluid phase.

6. The induction heating cooker according to claim 5, wherein the operating fluid of the hermetically sealed pipe is selected from the group consisting of methanol, ethanol, acetone, ammonia, and freon.

7. The induction heating cooker according to claim 1, wherein the at least one temperature sensor comprises any one of a contact temperature sensor or a non-contact temperature sensor.

8. The induction heating cooker according to claim 7, wherein the non-contact temperature sensor is an infrared temperature sensor.

9. The induction heating cooker according to claim 1, wherein the at least two working coils are disposed in a form of a grid or a honeycomb.

10. The induction heating cooker according to claim 1, wherein the at least two working coils are disposed below the cooking table, and the at least two heat transfer members extend from the at least one temperature sensor to the working coils.

11. The induction heating cooker according to claim 10, wherein the at least two heat transfer members are disposed to transfer heat to each of the working coils surrounding the at least one temperature sensor.

12. The induction heating cooker according to claim 10, wherein the at least two heat transfer members are disposed to transfer heat to two or more of the working coils disposed around the at least one temperature sensor.

13. The induction heating cooker according to claim 12, wherein only one of the at least two heat transfer members are disposed to transfer heat to only one of the working coils disposed around the at least one temperature sensor.

14. The induction heating cooker according to claim 1, wherein the at least one temperature sensor includes a sensing unit to cover a sensor element, and the at least two heat transfer members extend from one side of the sensing unit such that the at least two heat transfer members are integrated with the sensing unit.

15. The induction heating cooker according to claim 14, wherein the sensing unit comprises a plurality of sensing zones divided by heat insulation walls and sensor elements provided in the respective sensing zones, and the at least two heat transfer members extend from one side of each of the sensing zones.

16. An induction heating cooker comprising:

a main body;

a cooking table disposed at a top of the main body such that an object to be heated is placed on the cooking table;

a plurality of working coils disposed below the cooking table to heat the object;

an inverter unit to supply high-frequency current to the working coils;

a drive unit to turn a switching element of the inverter unit on/off;

a controller to control the drive unit;

at least one temperature sensor disposed between the working coils to measure temperature of the object; and at least two heat transfer members disposed around the at least one temperature sensor radially to transfer heat generated from the object heated by the working coils to the at least one temperature sensor, wherein the at least one temperature sensor is disposed radially outside the plurality of working coils, and connected to the working coils by the at least two heat transfer members, and wherein first ends of the at least two heat transfer members are disposed on a heating region of the at least two working coils between the at least two working coils and the cooking table and spaced apart from the at least two working coils, and second ends of the at least two heat transfer members are connected to the at least one temperature sensor.

17. The induction heating cooker according to claim 16, wherein the controller detects an output signal based on the at least one temperature measured by the at least one temperature sensor and stops an operation of the inverter unit when the temperature of the object is abnormally increased.

18. The induction heating cooker according to claim 16, further comprising:

a signal cutoff unit to turn a signal transmitted from the controller to the drive unit on/off based on the output signal of the at least one temperature sensor, wherein the signal cutoff unit cuts off the signal transmitted from the controller to the drive unit when the temperature of the object is equal to or greater than a predetermined temperature.

19. An induction heating cooker comprising:

a cooking table comprising one or more predetermined zones;

at least two working coils and at least one temperature sensor disposed below each of the one or more predetermined zones; and at least two heat transfer members to transfer heat from the at least two working coils to the at least one temperature sensor, wherein the at least one temperature sensor is disposed radially outside the at least two working coils, and connected to the at least two working coils by the at least two heat transfer members, and wherein first ends of the at least two heat transfer members are disposed on a heating region of the at least two working coils between the at least two working coils and the cooking table and spaced apart from the at least two working coils, and second ends of the at least two heat transfer members are connected to the at least one temperature sensor.

20. The induction heating cooker according to claim 19, wherein the at least two working coils are disposed below each of the one or more predetermined zones such that the working coils are next to each other, and the at least two heat transfer members comprise a plurality of heat transfer members, a number of which corresponds to a number of the working coils below each of the one or more predetermined zones, the heat transfer members extending from the at least one temperature sensor to the respective working coils.

21. The induction heating cooker according to claim 19, wherein the one or more predetermined zones comprise a plurality of predetermined zones disposed below the cooking table, the at least two working coils are disposed below the cooking table, the at least one temperature sensor comprises a plurality of temperature sensors disposed below the cooking table, and the at least two heat transfer members comprise a plurality of heat transfer members disposed below the cooking table.

* * * * *